US006485376B1

(12) United States Patent
Hisamatsu

(10) Patent No.: US 6,485,376 B1
(45) Date of Patent: Nov. 26, 2002

(54) GOLF CLUB SHAFT

(75) Inventor: Goro Hisamatsu, Gifu (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/705,249

(22) Filed: Nov. 2, 2000

(30) Foreign Application Priority Data

Mar. 31, 2000 (JP) ..... 2000-099150

(51) Int. Cl.[7] ..... A63B 53/10
(52) U.S. Cl. ..... 473/319; 428/36.3; 156/188
(58) Field of Search ..... 473/316–323; 428/36.3, 36.9; 264/635; 156/187, 188

(56) References Cited

U.S. PATENT DOCUMENTS 3,998,458 A * 12/1976 Inoue
4,157,181 A * 6/1979 Cecka
5,143,374 A 9/1992 Shibasaki
5,182,779 A * 1/1993 D'Agostino
5,326,099 A * 7/1994 Yamamoto
5,551,691 A * 9/1996 Harada
5,700,533 A * 12/1997 You

FOREIGN PATENT DOCUMENTS

| | | |
|---|---|---|
| JP | 2622428 | 5/1990 |
| JP | 6-278216 | 3/1993 |
| JP | 7-163689 | 4/1994 |
| JP | 9-253255 | 3/1996 |
| JP | 11-342233 | 3/1999 |

* cited by examiner

*Primary Examiner*—Stephen Blau
(74) *Attorney, Agent, or Firm*—Troutman Sanders LLP; Gerald R. Ross

(57) ABSTRACT

A golf club shaft includes an inner layer, an intermediate layer placed on the inner layer, and an outer layer placed on the intermediate layer. The intermediate layer has inclined yarns, which are substantially symmetric and have predetermined orientation angles relative to the longitudinal axis of the shaft, and longitudinal yarns, which are parallel to the longitudinal axis of the shaft. The orientation angles of the inclined yarns vary along the longitudinal axis of the shaft.

13 Claims, 6 Drawing Sheets

GOLF CLUB SHAFT

This application claims priority based on Japanese Patent Application No. 2000-099150 filed Mar. 31, 2000 and entitled "Golf Club Shaft."

BACKGROUND OF THE INVENTION

The present invention relates to a golf club shaft formed of fiber reinforced plastics, and more specifically, to a golf club shaft that maintains a desired flexural rigidity and strength and that has an improved distribution of linear density along the longitudinal shaft axis.

A general golf shaft club has an outside diameter that increases linearly from the tip end to the butt end so that the cross-sectional area of the shaft increases linearly. The distribution of linear density, which is the distribution of the mass of shaft material per unit length, is proportional to the axial variation of the cross-sectional area. Therefore, the linear density increases substantially linearly from the tip end to the butt end.

In relation to the distribution of linear density described above, a number of shafts with the varied distribution of linear density have been devised to improve their swing characteristics.

For example, Japanese Unexamined Patent Application No. Hei 7-163689 discloses a shaft that has at least one balancing weight placed within a cylindrical wall of composite material. The balancing weight is made of a formed sheet and is attached to the inner face of the cylindrical wall. Japanese Patent No. 2622428 discloses a shaft with a bulge. The bulge is produced by cutting sheets of prepregs into a predetermined shape and laminating them to drastically increase the outside and inside diameters of the shaft.

However, the distribution of flexural rigidity EI is limited in these shafts.

In the shaft with a weight (a balancing weight), the specific gravity of the weight is larger than that of carbon fiber reinforced plastics (CFRP). It is likely that the elastic modulus E of the weight is also larger than that of CFRP. Therefore, the flexural rigidity EI and the stress increase at the position where the weight is attached. This lowers the shaft strength.

The shaft with a bulge has the same problem. Provided that the shaft has an outside diameter ($d_2$) and an inside diameter ($d_1$), the second moment of area I of the shaft can be expressed as $\pi(d_2^4-d_1^4)/64$. The second moment of area I is increased either by increasing the outside diameter ($d_2$) or by decreasing the inside diameter ($d_1$). When the elastic modulus E is constant, the value EI will increase as the second moment I increases. More stress is applied on the location where the variation of flexural rigidity EI is greater. This reduces the shaft strength.

One method to improve the flexural rigidity EI is to introduce a separate object at the position on the shaft where second moment of area I should be increased (low E×high I=good EI). However, this increases the number of parts and manufacturing steps and thus increases manufacturing costs. Accordingly, this method is impractical.

Japanese Unexamined Patent Application No. Hei 6-278216 discloses a process of manufacturing a tubular body including a golf shaft. The process includes winding fibers over a mandrel, impregnating the fibers with a resin, heat curing the resulting material, and pulling out the mandrel. In this process, longitudinal yarns parallel to the longitudinal axis of the tubular body are provided. At least one of an inner layer and a part of an intermediate layer include the longitudinal yarns. A plurality of layers, including a layer which includes the longitudinal yarns, can be manufactured at a time. This process provides a tubular body that is manufactured in one step and that has a desired flexural rigidity EI. The yarns, except for the longitudinal yarns, are wound circumferentially and continuously over the mandrel. The flexural rigidity EI along the length of the tubular body may be varied by changing the winding angle. However, in this process, the distribution of mass of the shaft of the tubular body is not considered.

To solve these problems, it is an objective of the present invention to provide a golf club shaft that maintains a desired flexural rigidity EI and strength and that has an improved distribution of linear density along the longitudinal shaft axis.

SUMMARY OF THE INVENTION

The golf shaft club of the invention has a shaft extending between a tip portion and a butt portion. The shaft includes braided yarns of reinforcing fibers that form layers. The layers are hardened with resin. The layers include a varied layer that has yarns positioned substantially symmetrically at predetermined orientation angles relative to the shaft axis. The orientation angles are maximum at a predetermined location and decrease from the predetermined location towards the tip portion and the butt portion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
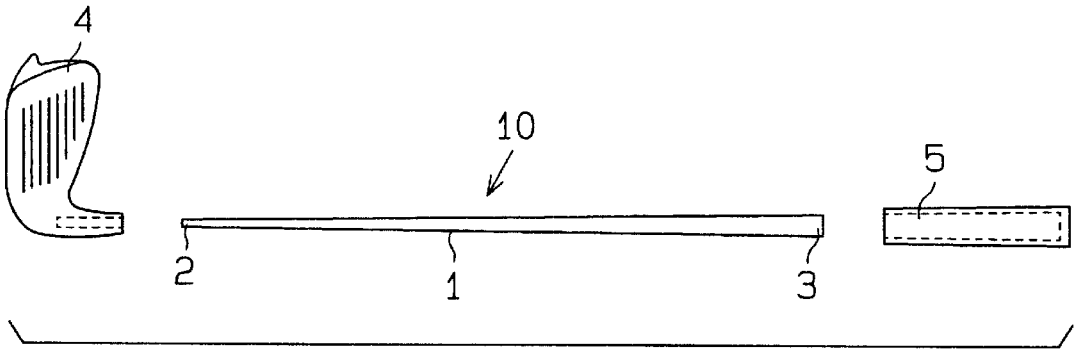
FIG. 1 is a front view showing a golf club, the shaft of which is made according to the invention.

FIG. 1 shows a golf club 10 having a tubular shaft 1 according to the invention. The club 10 includes the shaft 1 having a tip portion 2 and a butt portion 3, a head 4 attached to the tip portion 2, and a grip 5 attached to the butt portion 3.

Figure 2:
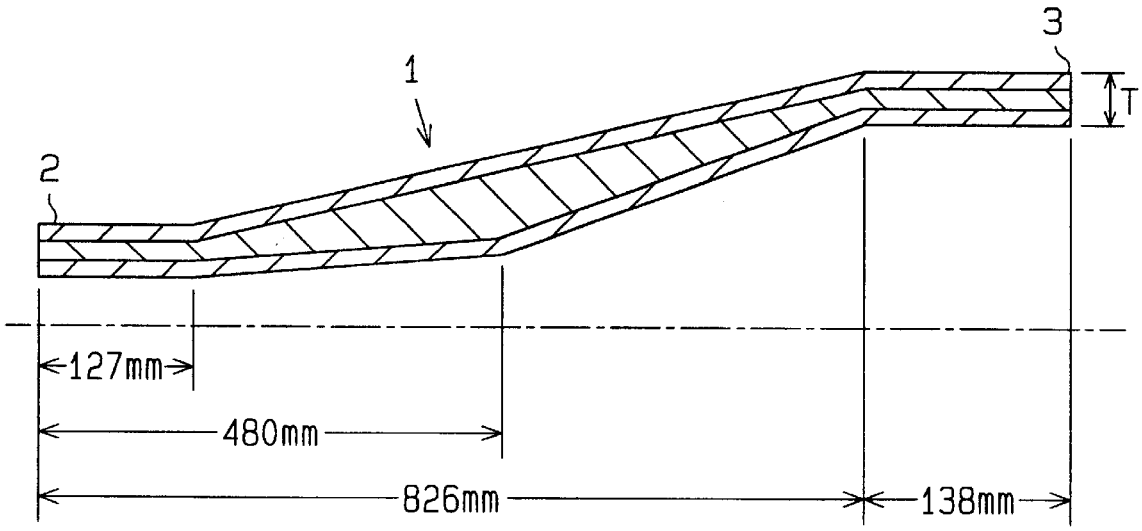
FIG. 2 is a partially enlarged cross-sectional view of the wall of the shaft of one embodiment of the invention.

To improve the swing characteristics of the golf club, the linear density of the shaft varies along its longitudinal axis, and balance of the shaft is adjusted. As shown in FIG. 2, the thickness T of the shaft 1 of one embodiment of the invention varies in the longitudinal direction in a mid-section of the shaft, which is between the tip portion 2 and the butt portion 3.

Figure 3A:
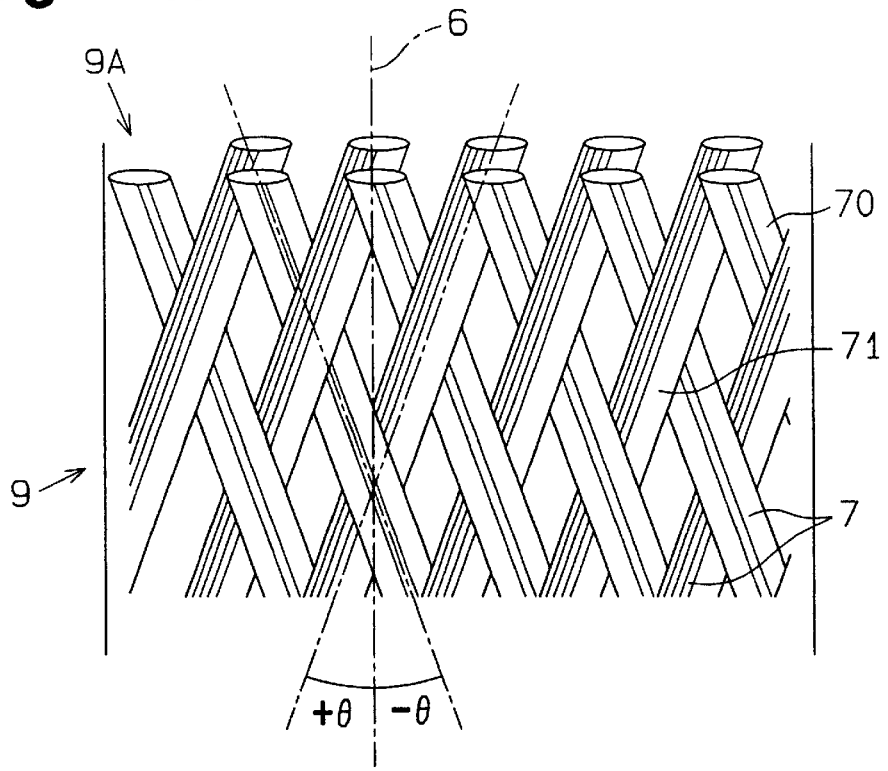
FIGS. 3A and 3B are enlarged views showing an arrangement of yarns in a layer of the golf club according to the invention.
Figure 3B:
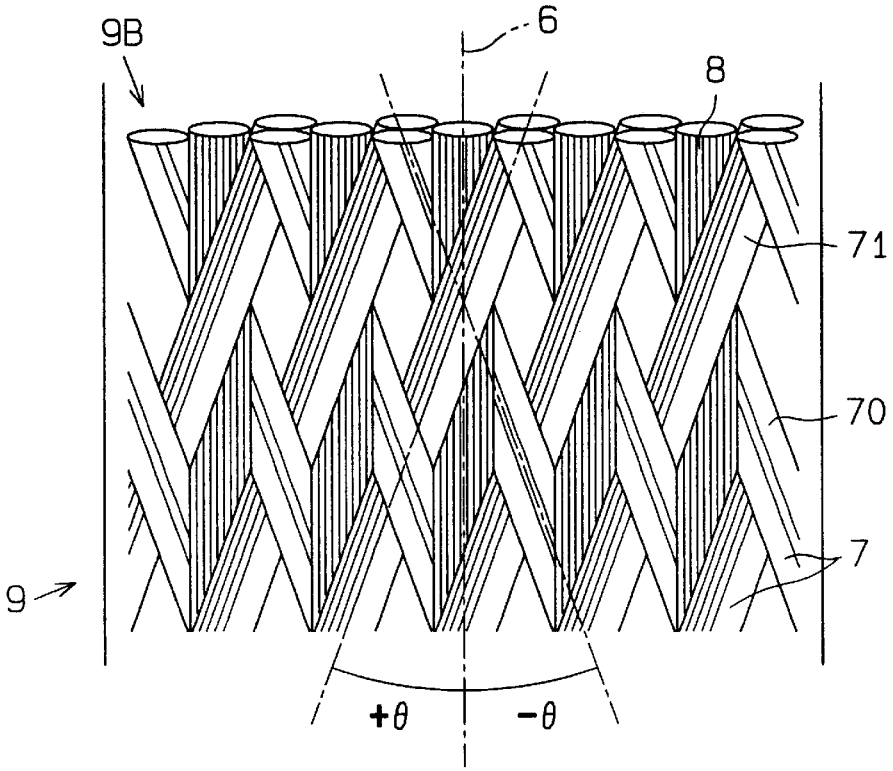

As shown in FIGS. 3A and 3B, a plurality of yarns 7, 8 are braided to form layers 9 (9A in FIG. 3A, 9B in FIG. 3B). The shaft 1 is formed by laminating the layers 9. Each yarn 7,8 is composed of a semihard tow prepreg. The tow prepreg is produced by impregnating a tow, a bundle of multiple reinforcing fibers.

For example, the shaft 1 is formed such that its linear density is maximized at a given point and decreases from the given point toward the tip portion 2 and the butt portion 3.

To adjust balance of the shaft 1 as described above, when the yarns 7 are braided, the orientation angles of the yarns 7 are varied relative to the longitudinal axis 6 of the shaft 1. The thus braided yarns 7 form the layers 9, which have a thickness T. At least one of the layers 9 determines the distribution of linear density of the shaft 1.

The decrease or the increase in thickness T is accomplished by gradually decreasing or increasing the orientation angles of yarns 70, 71 relative to the longitudinal axis 6. The yarns 70,71 are substantially symmetrical. The linear density varies in relation with the thickness T. For example, when the orientation angles of the yarns 70, 71 are increased at a chosen location, the mass of fibers used per unit length at the chosen location increases. The increase in mass of fibers leads to an increase in the shaft thickness T, the linear density, and the second moment of area I. Meanwhile, the elastic modulus E at the chosen location is decreased along the longitudinal axis 6 and thus the flexural rigidity EI is not drastically increased at the location. Accordingly no additional parts are required to concentrate the linear density at a specific location. Further, the fibers are wound continuously and stress is not localized at the chosen location. This maintains high shaft strength.

As shown in FIGS. 3A and 3B, the layer 9 that determines the thickness T may be formed in different ways. The layer 9A in FIG. 3A is formed by braiding two-directional yarns 70, 71 while varying the orientation angles ±θ of the yarns 70, 71 relative to the longitudinal axis 6. The layer 9B in FIG. 3B is formed by braiding two-directional yarns 70, 71 and yarns 8. The orientation angles ±θ are varied as in FIG. 3A. The layer 9B of FIG. 3B is used when the flexural rigidity EI of the shaft 1 needs to be improved.

To increase the thickness T of the shaft 1, the outside diameter of the shaft 1 may be increased or the inside diameter of the shaft 1 may be decreased. In either case, the orientation angles of the yarn 70, 71 are partially increased to concentrate the linear density. The elastic modulus E of the shaft 1 is kept small and a desired distribution of the flexural rigidity EI allocated to the shaft 1 is maintained.

EXAMPLE

An example of the golf club shaft according to the invention is described.

Figure 5:
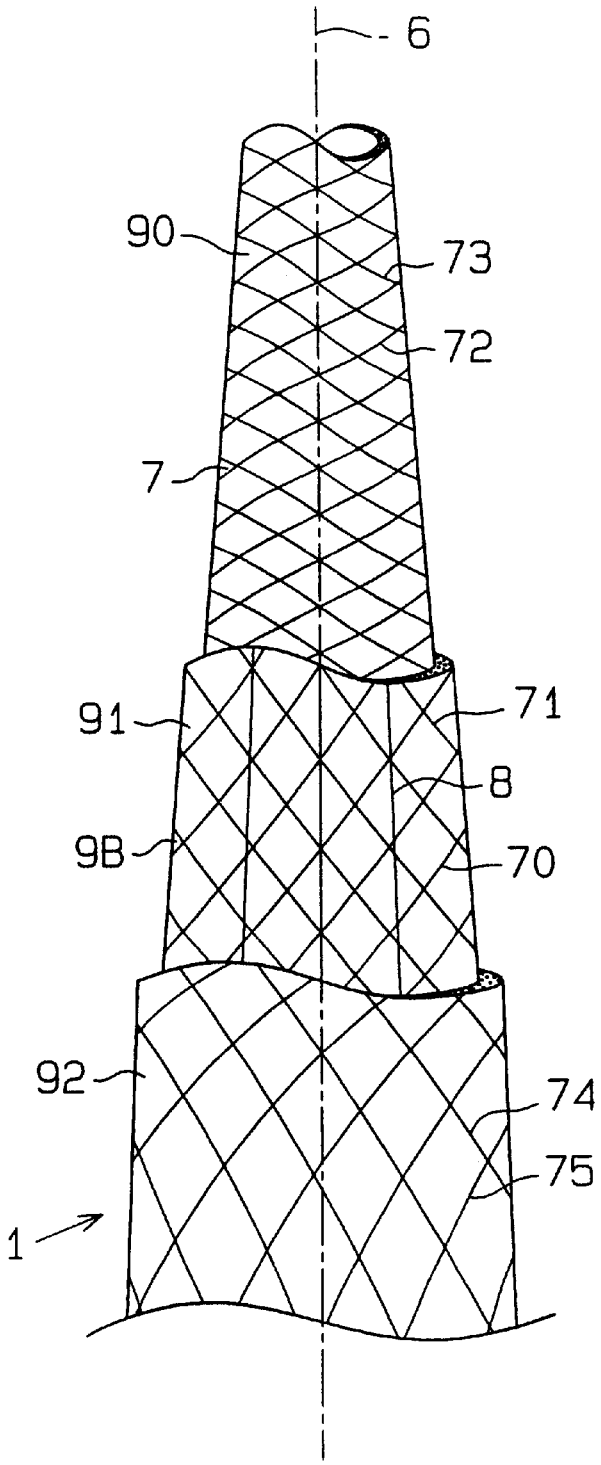
FIG. 5 is an enlarged cross-sectional view showing laminated layers of the shaft of FIG. 2.

The shaft 1, which has a total length 964 mm, was formed by laminating three layers 9 of braided yarns 7,8. FIG. 5 is an enlarged cross-sectional view illustrating the three layers 9. The layers 9 of the shaft 1 had an inner layer 90, an outer layer 92, and an intermediate layer 91 between the inner layer 90 and the outer layer 92.

The inner layer 90 was formed by two-directional yarns 7 (i.e., yarns 72, 73) of tow prepregs that were braided with orientation angles of ±60° relative to the longitudinal axis 6 along the entire length. The tow prepreg was a resin-impregnated tow, which was a bundle of 12000 carbon fibers, each of which had elastic modulus of 240 Gpa, a density of 1.8 g/cm$^3$, and a fineness of 800 g/km. Four tow prepregs were used in each direction.

The outer layer 92 was formed by two-directional yarns 7 (i.e., yarns 74, 73) that were braided with orientation angles of ±15° relative to the longitudinal axis 6 along the entire length. Eight tow prepregs were used in each direction.

The intermediate layer 91 was formed by yarns 8, which were parallel to the longitudinal axis 6, and two-directional yarns 7 (i.e., 70, 71) were braided together. Eight tow prepregs were used for the yarns 8 and ten tow prepregs were used for the two-directional yarns 70, 71.

The intermediate layer 91 was formed by the braided yarns 70, 71, 8, each of which had a different orientation angle ±θ. The orientation angles ±θ of yarns 70, 71 are varied along the longitudinal axis 6. As shown in FIG. 2, the angles ±θ of yarns 70, 71 were constant at ±30° in the range from the tip end to 127 mm. The angles ±θ increased continuously from ±30° to ±60° in the range from 127 mm to 480 mm. The angles ±θ decreased continuously from ±60° to ±20° in the range from 480 mm to 826 mm. The angles ±θ were constant at ±20° in the range from 826 mm to the butt end.

Figure 6:
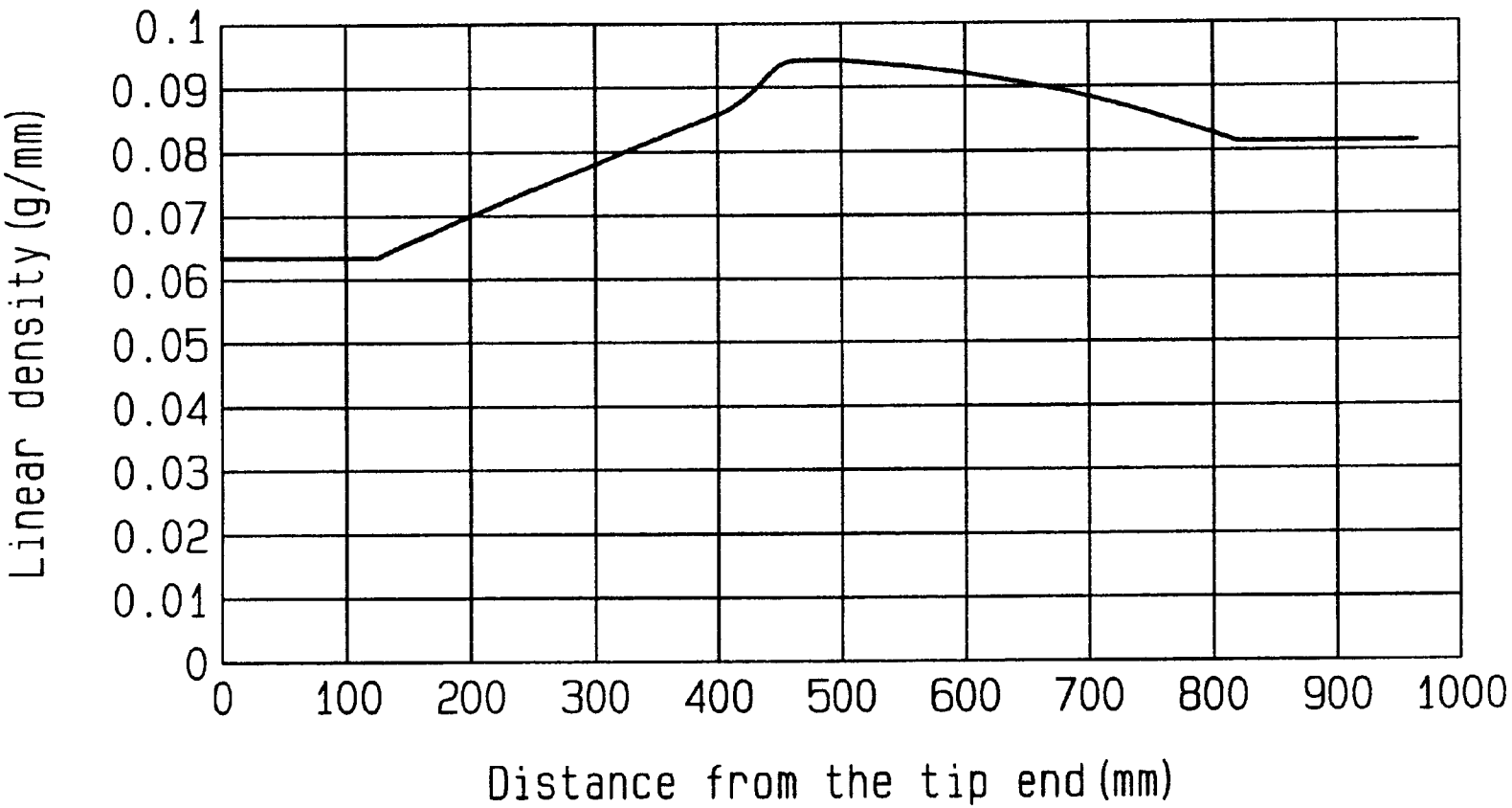
FIG. 6 is a graph showing the variation of linear density of the shaft of FIG. 2. The horizontal axis represents distances from the tip end of the shaft.

Since the orientation angles of two-directional yarns 72, 73 that formed the inner layer 90 were relatively large, the inner layer 90 was highly resistant to compression and had a high breaking strength. On the other hand, since the orientation angles of the two-directional yarns 74, 75 that formed the outer layer 92 were relatively small, the outer layer 92 was highly resistant to surface tension and compression, which occurs when the shaft 1 flexes. The outer shaft 92 also contributed increasing the breaking strength. The intermediate layer 91 serves to vary of the thickness T and second moment of area I of the shaft 1. That is, as shown in FIGS. 2 and 6, the thickness of the intermediate layer 91 and thus the thickness T of the shaft 1 were maximized at the location (480 mm) where the orientation angles of the yarns 70, 71 were maximum (±60°)

Since the fibers forming the shaft 1 are cut off halfway at 480 mm, the shaft 1 can be weighted and is continuous at the location. The deterioration of the strength is prevented in the inventive shaft compared with conventional shafts that are manufactured by introducing a separate part to adjust shaft balance or by polishing a fiber-layer to adjust the shaft thickness T.

Figure 7:
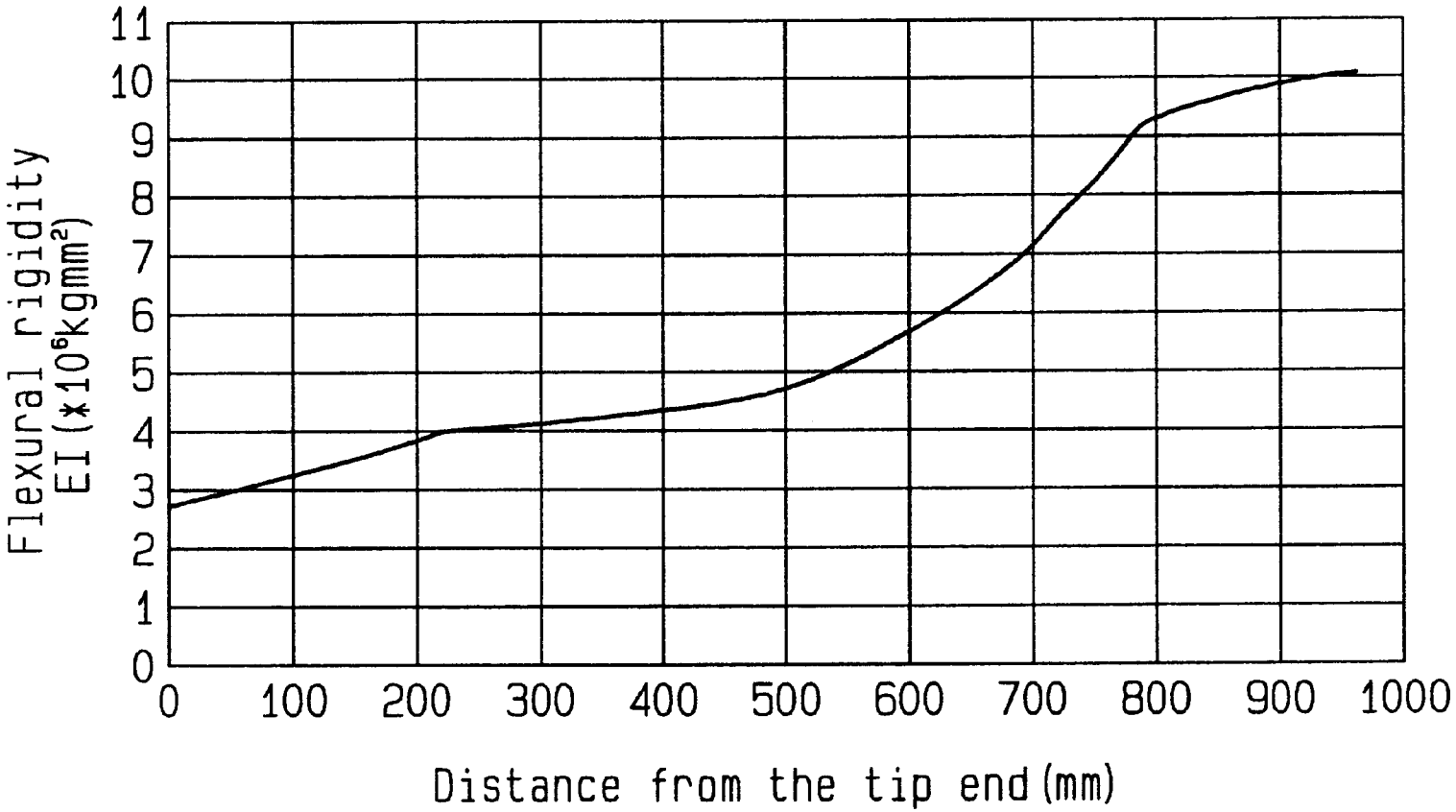
FIG. 7 is a graph showing the variation of flexural rigidity EI of the shaft of FIG. 2. The horizontal axis represents distances from the tip end of the shaft.

As also seen in FIG. 7, due to the large orientation angles ±θ of the yarns 70, 71, the longitudinal elastic modulus E is kept low at the 480 mm location in spite of a large second moment of area I. Flexural rigidity EI gradually increases from the tip portion to the butt portion. Therefore, the shaft 1 having desired flexural rigidity EI properties is manufactured. The shaft 1 is flexible at the 480 mm location.

The facts that the shaft is composed of the inner layer 90, the outer layer 92, and the intermediate layer 91 and that the intermediate layer 91 is formed of three yarns 8, 70, 71 improve the flexural rigidity EI. This composition reduces the number of the layers and provides a light shaft.

A portion of the outer layer 92 is removed by polishing during a finishing process. On the other hand, the longitudinal yarns 8 have an effect on the flexural rigidity EI of the shaft 1. Use of the yarns 8 in the outer layer 92 causes uneven flexural rigidity EI and is undesirable. In addition, use of the yarns 8 in the inner layer 90 causes increased resistance to compression and the decreased resistance to expansion in the longitudinal direction of the shaft 1. Therefore, use of the yarns 8 in the outer layer 92 and inner layer 90 is ineffective.

Figure 4A:
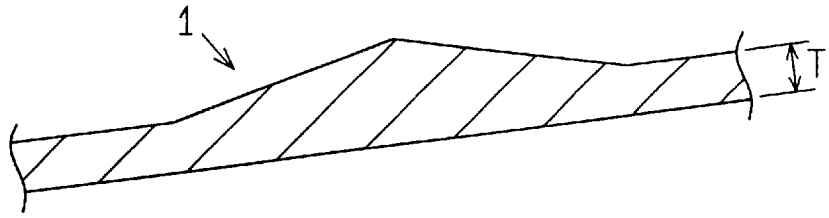
FIGS. 4A–4C illustrate cross-sectional profiles of the shafts of another embodiments according to the invention.
Figure 4B:
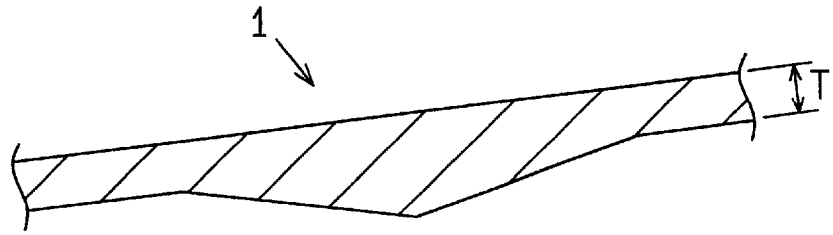
Figure 4C:
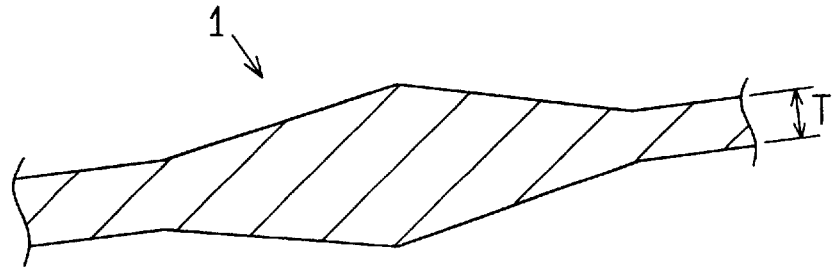

To vary the linear density in the longitudinal direction of the shaft 1 by varying the thickness T, bulges may be formed in the outside, the inside, or both sides of the shaft 1, as shown in FIGS. 4A to 4C. The axial length of the bulge may be large or small. The profile of the cross-section of the bulge may be a smooth curve or cornered. According to the invention, the shaft may have any shape. Further, without a, the shaft thickness T may be increased or decreased gradually by increasing or decreasing the rate of change of the inside diameter and the outside diameter.

It is necessary for the shaft to have a layer of the two-directional yarns or a layer of the two-directional yarns and the longitudinal yarns regardless of the shaft shape. The orientation angles of the two-directional yarns are maximized where the thickness T is maximized and are reduced as the thickness T is reduced.

Although the location of the maximum thickness of the shaft 1 is set near the middle portion of the shaft in the EXAMPLE, this does not limit the maximum location. Other locations along the shaft axis may be chosen in balancing the golf club. However, as shown in FIG. 6, the tip portion 2, which corresponds to the range from the tip end to about 130 mm, and the butt portion 3, which corresponds to the range from about 830 mm to butt end, are preferably excluded from the location of the maximum thickness.

As described above, the shaft of the present invention 30 has a designed linear density along the longitudinal shaft axis, which is accomplished by increasing or decreasing the orientation angle of yarns to vary the shaft thickness T. This allows the shaft to maintain a desired flexural rigidity EI and to balance.

Each yarn itself has a constant linear density. The thickness T can be determined by only adjusting the orientation angles of the yarns. This increases the design freedom of the shaft.

The thickness T is varied by two-directional yarns, the orientation angle of which varies along the shaft axis. Therefore, there are fewer fibers that are cut off. This strengthens the shaft.

No additional parts are used to increase the thickness T. Therefore the shaft has a continuous structure and the flexural rigidity EI are smoothly distributed. Stress is not localized and the shaft strength is maintained.

The substantially symmetric yarns 7 and the optional longitudinal yarns 8 are braided over the mandrel with alternate twining to form a seamless braided layer. This provides the inventive shaft with a good appearance and strength that is superior to the shafts manufactured by a sheet rolling process, in which sheets of prepregs are wound over the mandrel, and a filament winding process, in which fibers are wound around the mandrel while moving reciprocally along the longitudinal shaft axis.

It should be apparent to those skilled in the art that the present invention may be embodied in many other specific forms without departing from the spirit or scope of the invention.

Therefore, the present examples and embodiments are to be considered as illustrative and not restrictive and the invention is not to be limited to the details given herein, but may be modified within the scope and equivalence of the appended claims.

What is claimed is:

1. A golf club shaft comprising:

A shaft extending between a tip portion and a butt portion, wherein the shaft includes braided yarns of reinforcing fibers that form layers being hardened with resin, wherein the layers include a varied layer that has yarns positioned substantially symmetrically at predetermined orientation angels relative to the shaft axis, wherein the orientation angels are maximum at a predetermined location and decrease from the predetermined location towards the tip portion and the butt portion, and wherein flexural rigidity EI of the shaft gradually increases from the tip portion to the butt portion.

2. A golf club shaft according to claim 1, wherein the varied layer further includes yarns that extend parallel to the shaft axis along the entire length of the varied layer.

3. A golf club shaft according to claim 2, wherein the orientation angles are maximum near the middle portion of the shaft.

4. A golf club shaft according to claim 1, wherein the orientation angles are maximum near the middle portion of the shaft.

5. A golf club shaft comprising:

a shaft, wherein the shaft includes braided yarns of reinforcing fibers that form layers, the layers being hardened with resin, wherein the layers include:

a first layer, wherein the first layer has yarns which are positioned substantially symmetrically relative to the shaft axis;

a second layer laminated on the first layer, wherein the second layer has inclined yarns, which are positioned substantially symmetrically at predetermined orientation angles relative to the shaft axis, and linear yarns, which are parallel to the shaft axis along the entire length of the second layer, wherein the orientation angles of the inclined yarns vary along the shaft axis;

a third layer laminated on the second layer, wherein the third layer has yarns that are positioned substantially symmetrically relative to the shaft axis;

wherein the shaft extends between a tip portion and a butt portion, wherein the orientation angles of the inclined yarns of the second layer are maximum at a predetermined location and decrease from the predetermined location towards the tip portion and the butt portion; and wherein flexural rigidity EI of the shaft gradually increases from the tip portion to the butt portion.

6. A golf club shaft according to claim 5, wherein the yarns of the first layer are positioned at a first angle relative to the shaft axis, wherein the yarns of the third layer are positioned at a second angle relative to the shaft axis, wherein the first angle is larger than the second angle.

7. A golf club shaft according to claim 6, wherein the first angle is ±60° and the second angle is ±15°.

8. A golf club shaft according to claim 5, the orientation angles of the inclined yarns of the second layer are maximum near the middle portion of the shaft.

9. A method of manufacturing a golf club shaft comprising:

providing a fist layer, the first layer including yarns positioned substantially symmetrically relative to the shaft axis;

providing a second layer on the first layer, wherein the second layer has inclined yarns, which are positioned substantially symmetrically at predetermined orientation angles relative to the shaft axis, and linear yarns, which extend parallel to the shaft axis along the entire length of the second layer, wherein the orientation angles of the inclined yarns vary along the shaft axis;

providing a third layer on the second layer, wherein the third layer has yarns positioned substantially symmetrically relative to the shaft axis;

wherein the shaft extends between a tip portion and a butt portion, wherein the method includes maximizing the orientation angles of the inclined yarns of the second layer at a predetermined location such that the angles decrease from the predetermined location towards the tip portion and the butt portion; and arranging the inclined yarns and the linear yarns such that flexural rigidity EI of the shaft gradually increases from the tip portion to the butt portion.

10. A method according to claim 9, including positioning the yarns of the first layer at a first orientation angle relative to the shaft axis and positioning the yarns of the third layer at a second orientation angle relative to the shaft axis, wherein the first angle is larger than the second angle.

11. A method according to claim 10, the first angle is ±60° and the second angle is ±15°.

12. A method according to claim 9 including maximizing the orientation angles of the inclined yarns near the middle portion of the shaft.

13. A method according to claim 9, further including hardening the three layers with a resin.

* * * * *